US008895908B2

(12) United States Patent
Barry et al.

(10) Patent No.: US 8,895,908 B2
(45) Date of Patent: Nov. 25, 2014

(54) WING SLOT SEAL

(75) Inventors: William D. Barry, Billerica, MA (US); Robert Winkler, Swanzey, NH (US); John R. Franzini, Hollis, NH (US); Kenneth D. Cleveland, Nashua, NH (US); Adam Butland, Hudson, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 532 days.

(21) Appl. No.: 13/376,846

(22) PCT Filed: Apr. 7, 2011

(86) PCT No.: PCT/US2011/031584

§ 371 (c)(1), (2), (4) Date: Dec. 8, 2011

(87) PCT Pub. No.: WO2012/003025

PCT Pub. Date: Jan. 5, 2012

(65) Prior Publication Data

US 2014/0312575 A1 Oct. 23, 2014

Related U.S. Application Data

(60) Provisional application No. 61/321,816, filed on Apr. 7, 2010.

(51) Int. Cl.

| | |
|---|---|
| ***F42B 10/14*** | (2006.01) |
| ***B64D 45/00*** | (2006.01) |
| *F42B 10/00* | (2006.01) |

(52) U.S. Cl.

USPC ..... 244/3.27; 244/3.1; 244/3.24; 244/34 R; 244/35 R; 244/45 R; 244/46; 244/49; 244/117 R; 244/119; 244/121

(58) Field of Classification Search

CPC ..... F42B 10/02; F42B 10/14; F42B 10/143; F42B 10/146; F42B 10/60; F42B 10/62; F42B 10/64; F42B 99/00; E05C 9/02; E05C 21/00

USPC ..... 342/1–11; 343/700 R, 705, 708, 767, 343/770, 771, 872, 873; 102/382, 384, 400, 102/501, 502; 89/1.11, 1.1; 446/176, 211, 446/212; 244/1 R, 3.1–3.3, 158.1, 171.7, 244/172.6, 34 R, 35 R, 45 R, 46, 49, 117 R, 244/119, 121, 129.1, 129.4

See application file for complete search history.

(56) References Cited

U.S. PATENT DOCUMENTS 3,413,640 A * 11/1968 Freeman et al. ..... 343/771
3,803,751 A * 4/1974 Pippin, Jr. ..... 446/211

(Continued)

*Primary Examiner* — Bernarr Gregory

(74) *Attorney, Agent, or Firm* — Maine Cernota & Rardin; Douglas P. Burum; Daniel J. Long

(57) ABSTRACT

A low cost, lightweight frangible wing slot seal can be applied to a guidance wing slot of a folding fin aerial rocket or missile, providing a barrier against exposure of internal missile components to external contaminants, while allowing unhindered deployment of missile guidance wings simply by bursting through the seals. The simple design is nearly foolproof, and has no impact the likelihood of weapon failure. The seal is a flexible sheet which is sufficiently thin so as not to exceed the required volume envelope of the missile. The sheet includes a burst seam, which is breached when impacted by the leading edge of a deploying wing. No additional wing deployment force is required, and after deployment the seal has minimal impact on the aerodynamic performance of the wing.

12 Claims, 8 Drawing Sheets

(56) References Cited

U.S. PATENT DOCUMENTS

| | | | | | |
|---|---|---|---|---|---|
| 3,921,937 | A | * | 11/1975 | Voss et al. | 244/3.27 |
| 3,965,611 | A | * | 6/1976 | Pippin, Jr. | 446/211 |
| 4,351,499 | A | * | 9/1982 | Maudal et al. | 244/3.27 |
| 4,411,398 | A | * | 10/1983 | Wedertz et al. | 244/3.28 |
| 4,568,044 | A | * | 2/1986 | DiTommaso et al. | 244/49 |
| 4,838,502 | A | * | 6/1989 | Pinson | 244/49 |
| 5,004,186 | A | | 4/1991 | Hans et al. | |
| H1219 | H | * | 8/1993 | Miller | 343/708 |
| 5,393,011 | A | | 2/1995 | Dunn et al. | |
| 5,630,564 | A | | 5/1997 | Speicher et al. | |
| 5,904,319 | A | | 5/1999 | Hetzer | |
| 6,446,906 | B1 | * | 9/2002 | Voigt et al. | 244/3.27 |
| 6,588,700 | B2 | * | 7/2003 | Moore et al. | 244/3.28 |
| 6,880,780 | B1 | * | 4/2005 | Perry et al. | 244/3.27 |
| 7,175,131 | B2 | * | 2/2007 | Dodu et al. | 244/3.24 |
| 7,556,220 | B2 | * | 7/2009 | Schulz | 244/129.4 |
| 7,829,830 | B1 | * | 11/2010 | Rogers | 244/3.27 |
| 7,856,929 | B2 | * | 12/2010 | Gavin et al. | 102/502 |
| 8,476,564 | B2 | * | 7/2013 | Henry et al. | 244/3.27 |

* cited by examiner

WING SLOT SEAL

RELATED APPLICATIONS

This application claims the benefit of U.S. Provisional Application No. 61/321,816, filed Apr. 7, 2010, herein incorporated by reference in its entirety for all purposes.

STATEMENT OF GOVERNMENT INTEREST

The invention was made with United States Government support under Contract No. W31P4Q-06-C-0330 awarded by the Navy. The United States Government has certain rights in this invention.

FIELD OF THE INVENTION

The invention relates to ballistic weaponry, and more particularly to folding fin aerial rockets and missiles.

BACKGROUND OF THE INVENTION

Aerial rockets and missiles which include guidance wings have been in use at least since the late 1940's, with the FFAR (Folding Fin Aerial Rocket) being used in the Korean and Vietnam conflicts, and the more recent Hydra 70 family of WAFAR (Wrap-Around Fin Aerial Rocket) and the Advanced Precision Kill Weapon. System (APKWS) laser guided missile. The guidance wings for these weapons are typically folded within the main fuselage in a stowed configuration until the weapon is launched, at which point the wings are extended through slots in the fuselage and deployed in a flight configuration.

While foldable wing designs provide the advantages of compact storage and reduced launcher size, the slots in the fuselage required for deployment of the wings tend to create a hazard that internal components of the weapon will be exposed to contaminants. These can include natural contaminants, such as salt, moisture from fog, moisture from humidity, blowing sand, blowing dust, and such like. The internal components can also be exposed to induced contaminants, such as debris from an adjacent rocket launch, and contaminants resulting from handling of the missile.

One approach is to provide retractable or openable covers over the wing slots. However, such mechanisms add weight and cost to the missile, take up space which may be needed for other components, and tend to be complex and prone to failure.

What is needed, therefore, is a wing slot seal which will protect the internal components of a rocket or missile from external contaminants while the wings are in their stowed configuration, will interfere as little as possible with deployment of the wings, and will not substantially affect the aerodynamics of the missile once the wings are deployed, all without consuming significant space and without adding significant weight, cost, complexity, or likelihood of failure.

SUMMARY OF THE INVENTION

The present invention is a simple, low cost, lightweight wing slot seal which provides a frangible barrier against exposure of internal components of a rocket or missile to external contaminants, while enabling deployment of a wing stored within the rocket or missile simply by bursting of the wing through the frangible seal. The seal is strong enough to resist rupture or dislodgement from the exterior due to normal transport and handling of the missile, while at the same time presenting minimum resistance to penetration from the interior when the guidance wings are deployed by bursting through the seal. The invention itself includes no moving parts, and is therefore unaffected by exposure to contaminants. The simple design of the invention also provides no significant increase in the likelihood of weapon failure.

The invention includes a thin, flexible sheet which can be adhered to a surface of the fuselage of the rocket or missile so as to cover a wing slot. In embodiments, the seal is sufficiently thin so as not to exceed the diameter of "bore riders" of the missile which define the maximum diameter of the missile, and which support the missile when resting within a cylindrical launching or transporting tube.

The thin, flexible sheet includes an outer layer and an inner layer. In embodiments, both of the layers are made of a nickel alloy, and in some of these embodiments one layer is made of half-hard nickel sulfamate, while the other layer is made of fully hard nickel sulfamate. The inner layer includes at least one penetration cut or "burst seam" which assists the wing in breaking through the seal for deployment. The flexible sheet is curved according to the cylindrical shape of the rocket or missile, and the two layers are stiff, although flexible, so that inward deformation due to pressure applied from outside the rocket or missile tends to force the edges of the burst seam together, thereby resisting the applied force, while outward deformation caused by the wing pressing against the seal from within the rocket or missile tends to force the edges of the burst seam apart, so that the wing passes through the cut or cuts in the inner layer and is only required to break through the outer layer.

In embodiments, the flexible sheet is resilient or "springy," so that once the wing is deployed, portions of the flexible sheet which lie against the deployed wing remain substantially flush against the wing, while portions of the flexible sheet which are not adjacent to the deployed wing tend to spring back into place and close the opening made in the frangible seal. The effect of the frangible seal on the aerodynamics of the rocket or missile is thereby minimized.

Embodiments of the invention include a puncture feature at a location where the wing first makes contact with the seal during wing deployment. The puncture feature includes a region where the inner layer is omitted and where at least one puncture initiator is attached to the inner surface of the outer layer, the puncture initiators being isolated from each other and from the inner layer. The puncture initiators are arranged so that impact with the leading edge of the wing during the initial stages of wing deployment will tend to drive the puncture initiators into the outer layer, causing the puncture initiators to pierce the outer layer and to provide perforations which will assist the wing in breaking through the outer layer.

The present invention is a frangible wing slot seal suitable for preventing penetration of contaminants through a wing slot provided in the fuselage of a folding fin aerial rocket or missile, the wing slot seal being frangible so as to permit deployment of a guidance wing through the wing slot by breaking of the guidance wing through the wing slot seal, the wing slot seal. The wing slot seal includes a barrier sheet having an inner layer and an outer layer, the barrier sheet having dimensions sufficient for covering the wing slot and for overlapping a region of fuselage surrounding the wing slot, the barrier sheet having a curvature corresponding substantially to a curvature of the fuselage, at least one of the inner and outer layers being a stiff layer which is resistant to deformation.

The wing slot seal further includes a burst seam formed in the stiff layer of the barrier sheet, the burst seam being configured so as to allow a guidance wing to separate and pass through the burst seam during deployment of the guidance wing, the burst seam being configured to close and resist penetration when a force is applied to the barrier sheet from outside of the rocket or missile, and an adhesive layer at least applicable to an inner surface of the barrier sheet, the adhesive layer being configured for adhering the barrier sheet to the region of fuselage surrounding the wing slot, the adhesive layer providing an adhesive strength which is sufficient to maintain the barrier sheet in position over the wing slot while the guidance wing breaks through the barrier sheet during deployment of the guidance wing.

In embodiments, the stiff layer is the inner layer of the barrier sheet.

In various embodiments at least one of the inner layer and the outer layer of the barrier sheet is a resilient layer which tends to restore the barrier sheet to its original configuration after the guidance wing has broken through the barrier sheet. Some of these embodiments further include at least one cross-seam formed in the stiff layer and configured so as to cause the formation of a first pair of flaps and a second pair of flaps in the barrier sheet when the guidance wing breaks thorough the barrier sheet, the first pair of flaps being configured to rest against the guidance wing after the guidance wing is deployed, and the second pair of flaps being configured to return approximately to its original configuration and to thereby at least partly cover the wing slot after the guidance wing has been deployed. And in some of these embodiments the first pair of flaps is approximately triangular in shape, and the second pair of flaps is approximately rectangular in shape.

In certain embodiments one of the layers of the barrier sheet is a layer of half-hard nickel sulfamate, and the other layer of the barrier sheet is a layer of full-hard nickel sulfamate.

Various embodiments further include a burst initiating region which is contiguous with the burst seam and formed at a location of initial contact between the deploying guidance wing and the barrier sheet, the inner layer being absent from the burst initiating region, the burst initiating region including at least one burst assisting feature attached to the outer layer in the burst initiating region, the burst assisting feature, upon contact with the deploying guidance wing, tending to press against and perforate the outer layer of the barrier sheet. In some of these embodiments the at least one burst assisting feature is formed of the material of the inner layer, and is shaped by exclusion of the inner layer material from a region surrounding the burst assisting feature. In other of these embodiments the burst assisting feature is substantially co-planar with the inner layer of the barrier sheet, the burst assisting feature tending to tip out of the plane of the inner layer upon contact with the deploying guidance wing so as to press an edge of the burst assisting feature against the outer layer of the barrier sheet. And in some of these embodiments the edge of the burst assisting feature is at least one of sharp and pointed.

In certain embodiments the wing slot seal is able to inhibit penetration of moisture through the wing slot. And some embodiments further include an alignment feature suitable for alignment with a compatible alignment feature provided on the fuselage of the rocket or missile, the alignment feature thereby facilitating attachment of the wing slot seal to the fuselage at a desired location and with a desired alignment.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
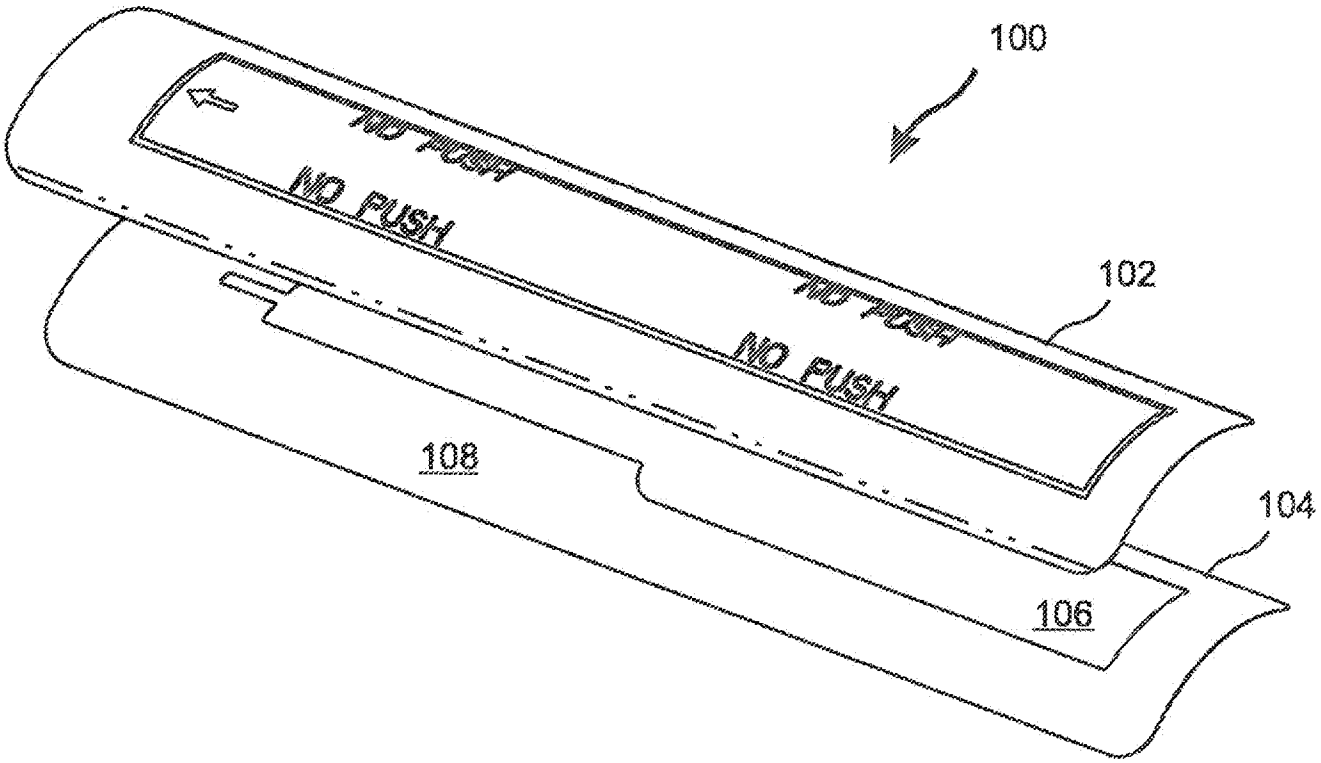
FIG. 1 is a perspective, exploded view of an embodiment of the present invention, showing a separated flexible sheet and adhesive layer.

With reference to FIG. 1, the present invention is a simple, low cost, lightweight wing slot seal 100 which provides a frangible barrier against exposure of internal components of a rocket or missile (800 in FIG. 8) to external contaminants, while enabling deployment of a wing (600) stored within the rocket or missile (800) simply by bursting of the wing 600 through the frangible seal 100. The seal 100 is strong enough to resist rupture or dislodgement from the exterior of the rocket or missile 800 due to normal transport and handling of the rocket or missile 800, while at the same time presenting minimum resistance to penetration from the interior when the guidance wings 600 are deployed by bursting through the seal 100. The invention itself includes no moving parts, and is therefore unaffected by exposure to contaminants. The simple design of the invention also provides no significant increase in the likelihood of weapon failure.

The invention includes a thin, flexible sheet 102 which can be attached by an adhesive layer 104 to a surface of the fuselage of a rocket or missile 800 so as to cover a wing slot 802. In embodiments, the seal 100 is sufficiently thin so as not to exceed the diameter of "bore riders" of the missile 800 which define the maximum diameter of the missile 800, and which support the missile 800 when resting within a cylindrical launching or transporting tube.

In some embodiments, the adhesive layer is a layer of adhesive applied directly to the barrier layer. In the embodiment of FIG. 1, the adhesive is an independent, physical layer 104 of adhesive which initially includes non-adhesive backing sheets on both surfaces. One backing sheet is removed so as to apply the adhesive layer to the flexible sheet 102, and the second backing sheet is removed in preparation for applying the assembled flexible sheet 102 and adhesive layer 104 to the wing slot 802. The adhesive layer 104 includes an opening 106 in its central region sufficiently large and appropriately shaped so as to allow the deploying wing 600 to pass through the adhesive layer 104 without making substantial contact with the adhesive 108.

Figure 2B:
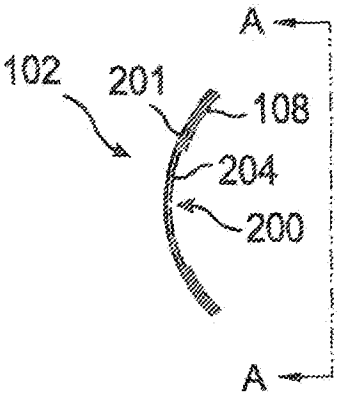
FIGS. 2A, 2B, and 2C are top, side, and bottom views respectively of the assembled flexible sheet and adhesive layers of FIG. 1.
Figure 2A:
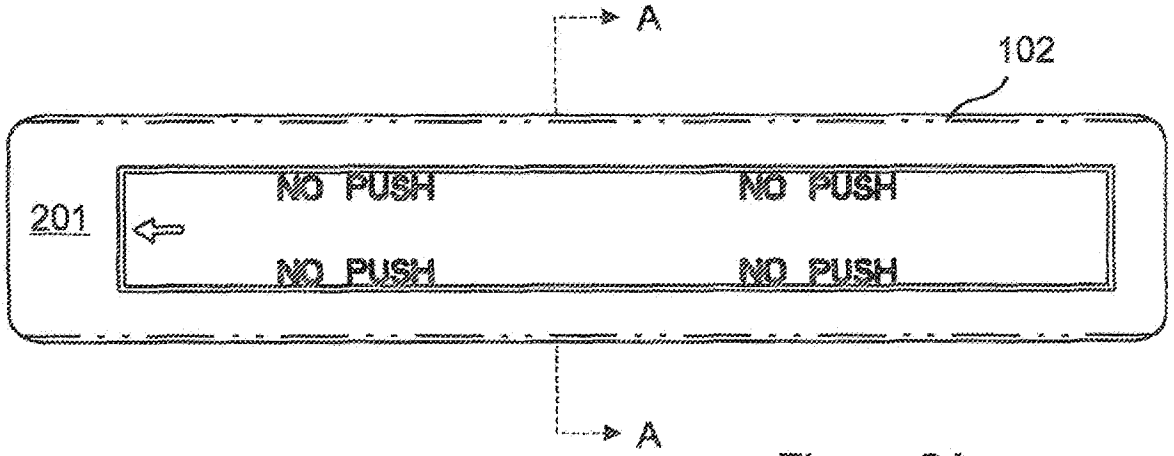
Figure 2C:
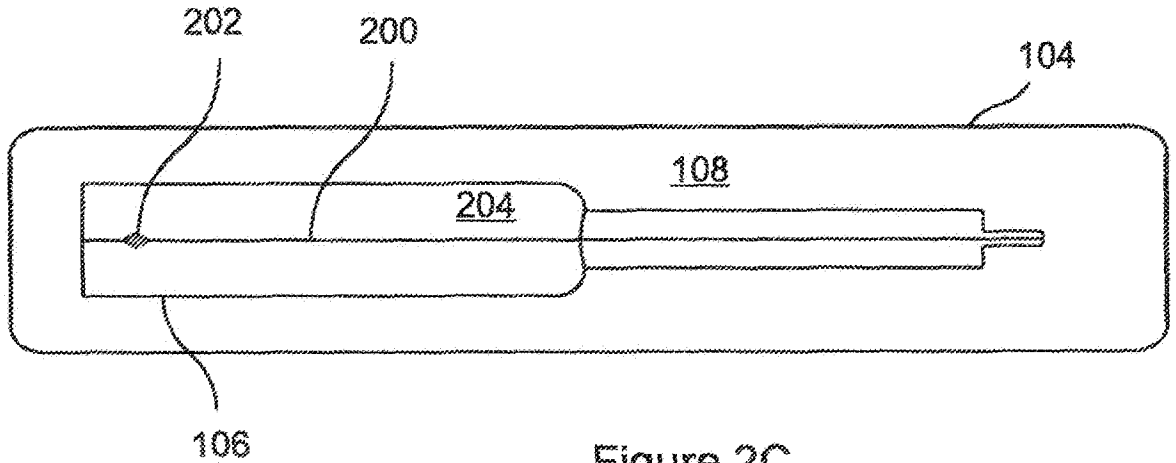

FIGS. 2A, 2B, and 2C are top, side, and bottom views respectively of the assembled flexible sheet 102 and adhesive layer 104. It can be seen in FIG. 2B that the thin, flexible sheet 102 includes an outer layer 201 and an inner layer 204. In embodiments, both of the layers 201, 204 are made of a nickel alloy, and in some of these embodiments one layer 201 is made of half-hard nickel sulfamate, while the other layer 204 is made of fully hard nickel sulfamate. The inner layer 204 includes at least one penetration cut or "burst seam" 200 which assists the wing 600 in breaking through the seal 100 for deployment. In the bottom view of FIG. 2C, the burst seam 200 of the barrier layer can be seen through the opening in the adhesive layer.

Figure 3B:
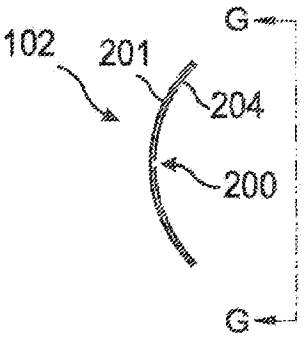
FIGS. 3A, 3B, and 3C are top, side, and bottom views respectively of the flexible sheet of FIG. 1, shown without the adhesive layer.
Figure 3A:
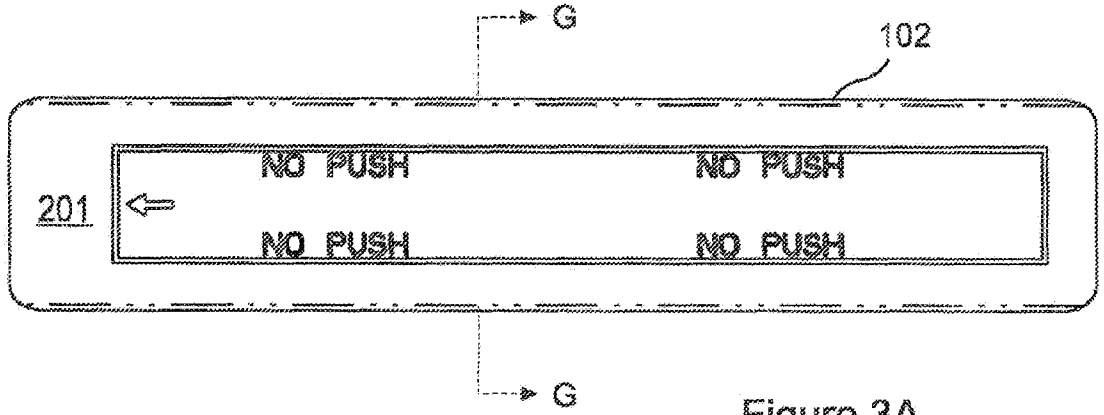
Figure 3C:
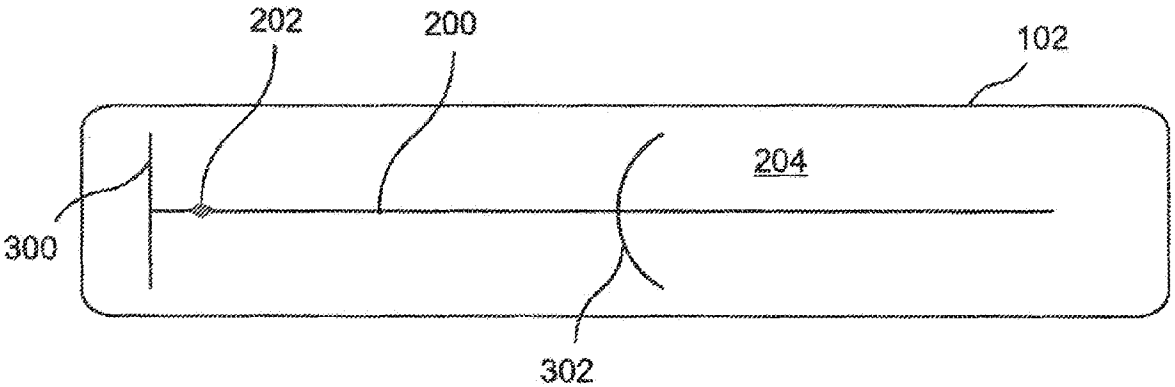

FIGS. 3A, 3B, and 3C are top, side, and bottom views respectively of the flexible sheet 102 without the adhesive layer 104. The full extent of the burst seam 200 is clearly visible in the bottom view of FIG. 3C, as well as vertical seams 300, 302, which enable portions of the inner layer 204 to form shaped flaps 804, 806 when the wing is deployed through the flexible sheet 102. This is discussed in more detail below in reference to FIG. 8.

Figure 4B:
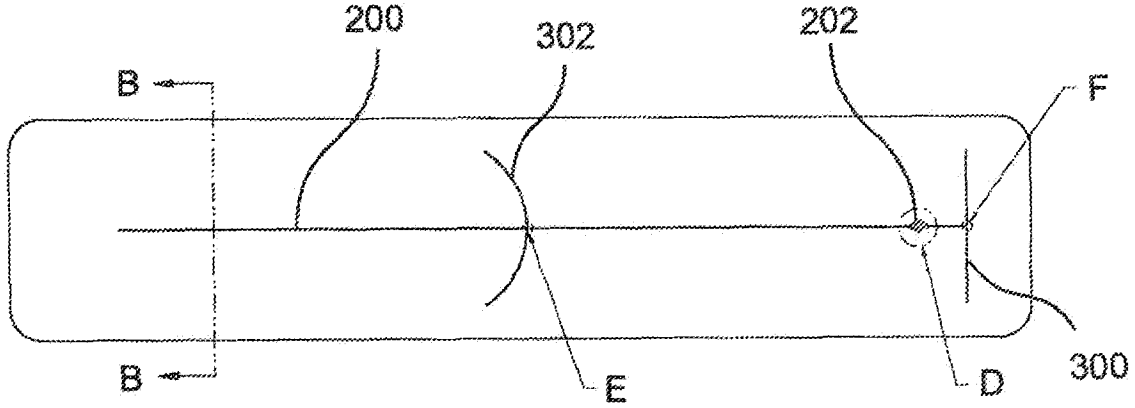
FIG. 4B is a cross sectional view of the inner layer of FIG. 4A.
Figure 4B:
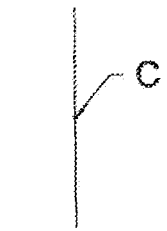
Figure 4A:
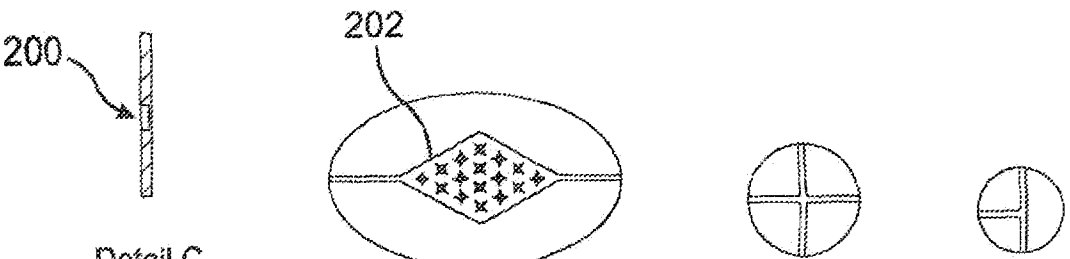
FIG. 4A is a top view of the inner layer of the flexible sheet of FIG. 1, including expanded details thereof.

FIGS. 4A and 4B are top and cross sectional views respectively of the inner layer 204 of the embodiment of FIG. 1, illustrated in a flat configuration before being shaped by thermoforming to the curvature of the missile fuselage. The figures provide more detailed illustrations of the inner layer 204, including details of several regions specific regions.

Figure 5:
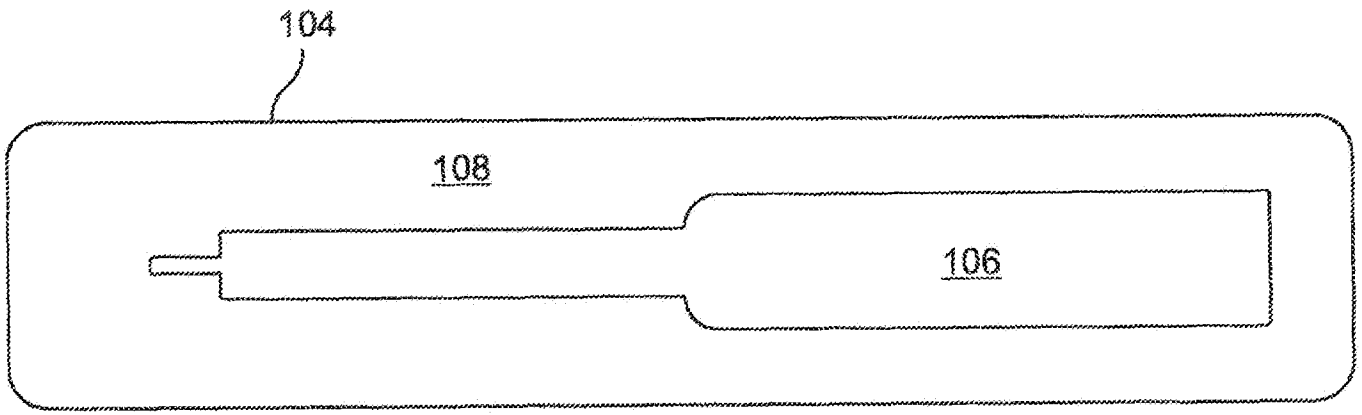
FIG. 5 is top view of the adhesive layer of FIG. 1.

FIG. 5 is a top view of the adhesive layer of the embodiment of FIG. 1, which in this embodiment is a pressure-sensitive adhesive.

Figure 6A:
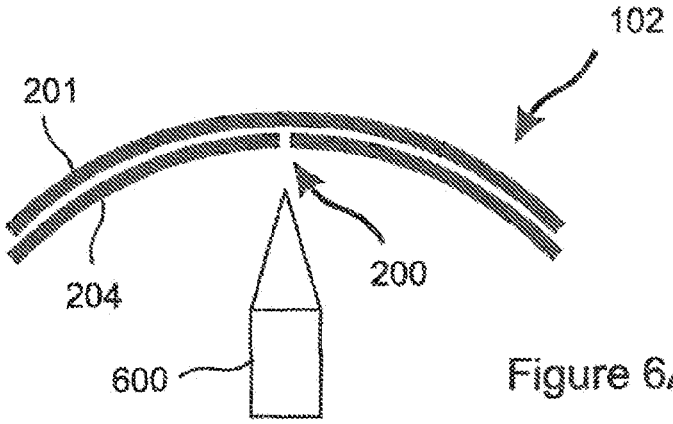
FIG. 6A is a simplified side cross sectional view of a wing leading edge positioned near a burst seam of a flexible sheet.

FIG. 6A is a simplified illustration showing the leading edge of a wing 600 aligned with a burst seam 200 in the inner layer 201 of the flexible sheet 100. In the embodiment of FIG. 6A, the inner layer 204 is stiff, although flexible. As can be seen in FIG. 6A, and also in the side views of FIG. 2B and FIG. 3B, the flexible sheet 102 is curved according to the cylindrical shape of the rocket or missile.

Figure 6B:
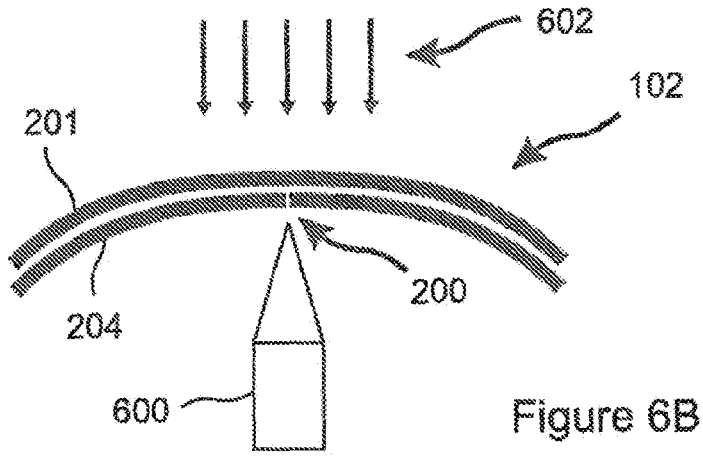
FIG. 6B illustrates the effect of an external force applied to the flexible sheet of FIG. 6A.
Figure 6C:
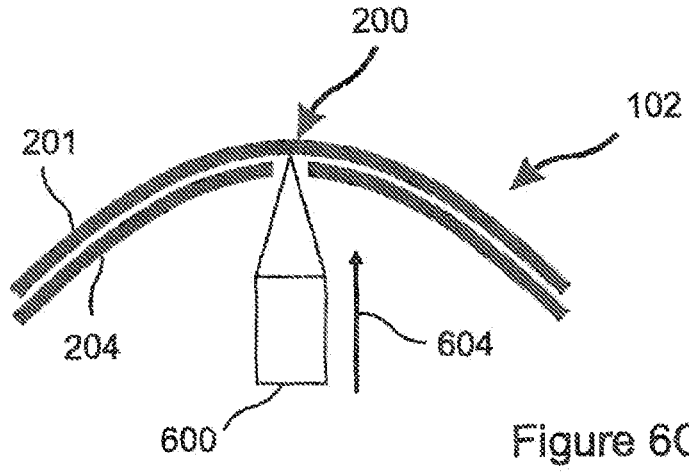
FIG. 6C illustrates the effect of an internal force applied to the burst seam of the flexible sheet by the leading edge of the wing.

As can be seen in FIG. 6B, an inward deformation of the flexible sheet 102 due to a force 602 applied from outside the rocket or missile 800, for example due to normal handling and transport of the rocket or missile 800, tends to force the edges of the burst seam 200 together, thereby closing the burst seam 200 and resisting the applied force 602. On the other hand, as is illustrated in FIG. 6C, an outward deformation 604 of the flexible sheet 102 caused by the wing 600 pressing against the flexible sheet 102 from within the rocket or missile 800 tends to force the edges of the burst seam 200 apart, thereby opening the burst seam so that the wing can pass through the cut or cuts in the inner layer 204 and need only break through the outer layer 201.

Figure 7A:
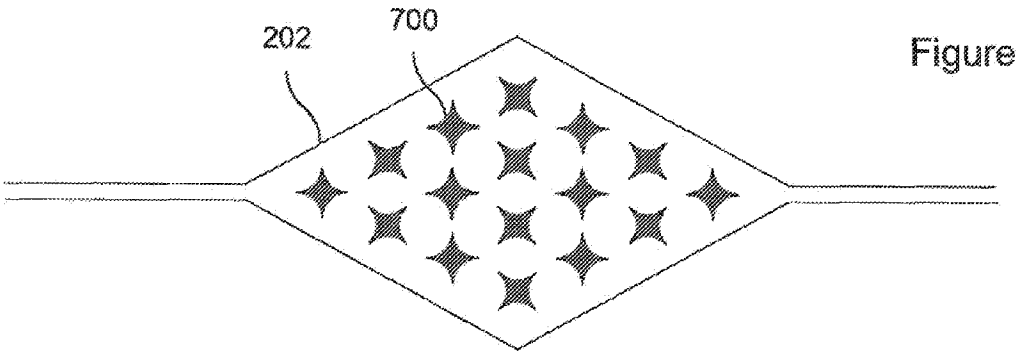
FIG. 7A is an expanded rear view of the puncture feature of the embodiment of FIG. 2C.
Figure 7B:
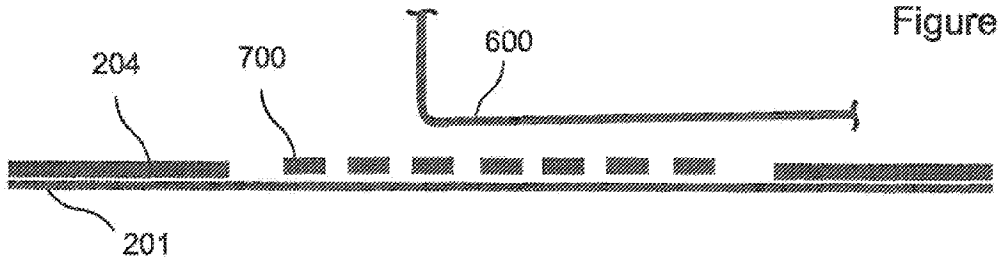
FIG. 7B is a side view of the puncture feature of FIG. 7A

FIGS. 7A and 7B, are close up rear and side cross section views respectively of a puncture feature 202 which is included in the flexible sheet 102 in the embodiment of FIG. 3C. The puncture feature 202 is in a location where the wing 600 first makes contact with the flexible sheet 102 during wing deployment. In embodiments the puncture feature 202 is a region 202 where the inner layer 204 is omitted, and where at least one puncture initiator 700 is attached to the inner surface of the outer layer 201, the puncture initiators 700 being isolated from each other and from the inner layer. In the embodiment of FIG. 7B, the inner layer 204 is applied to the outer layer 201 by a metal deposition process, whereby discontinuities in the inner layer 204 which form the burst seams 200 and the puncture feature 202 are created by applying a mask to the inner surface of the outer layer 201 before the depositing the inner layer 204. As can be seen in FIGS. 7A and 7B, in this embodiment the puncture initiators 700 are essentially isolated "star-shaped" portions of deposited inner layer material which are not directly connected to each other or to the inner layer 204, but are only indirectly connected through their mutual attachment to the outer layer 201.

Figure 7C:
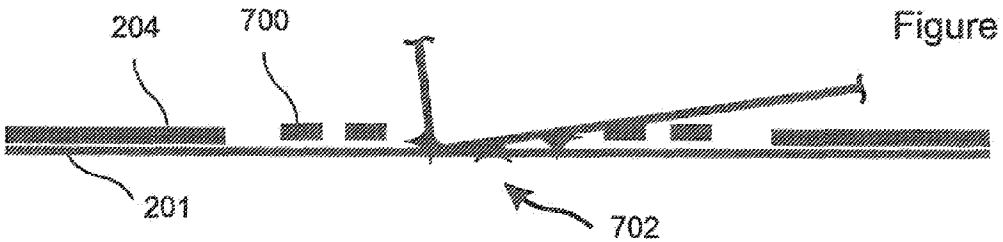
FIG. 7C illustrates the action of the puncture initiators of FIG. 7A when impacted by the leading edge of the wing.

The puncture initiators 700 in the embodiment of FIGS. 7A through 7C are flat shapes with points. As shown in FIG. 7C, when the leading edge of the deploying wing 600 impacts the puncture feature 202 during the initial stages of wing deployment, some of the star-shaped puncture initiators 702 are tipped out of the plane of the flexible sheet 102, and their points are driven through the outer layer 201. The puncture initiators 700 thereby perforate the outer layer 201 and assist the wing 600 in breaking through the outer layer 201.

Figure 8A:
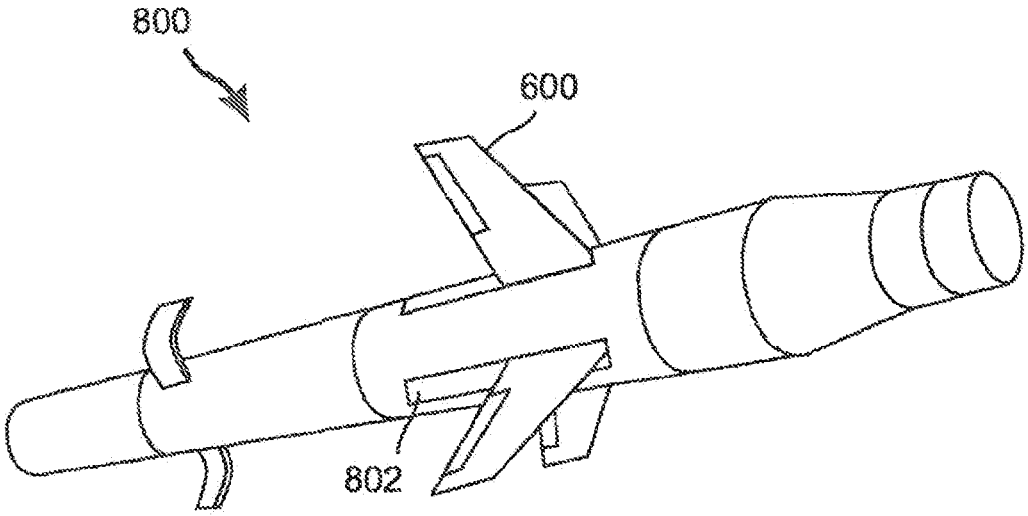
FIG. 8A is a perspective view of a folding wing aerial missile, shown with the wings deployed but without the present invention.
Figure 8B:
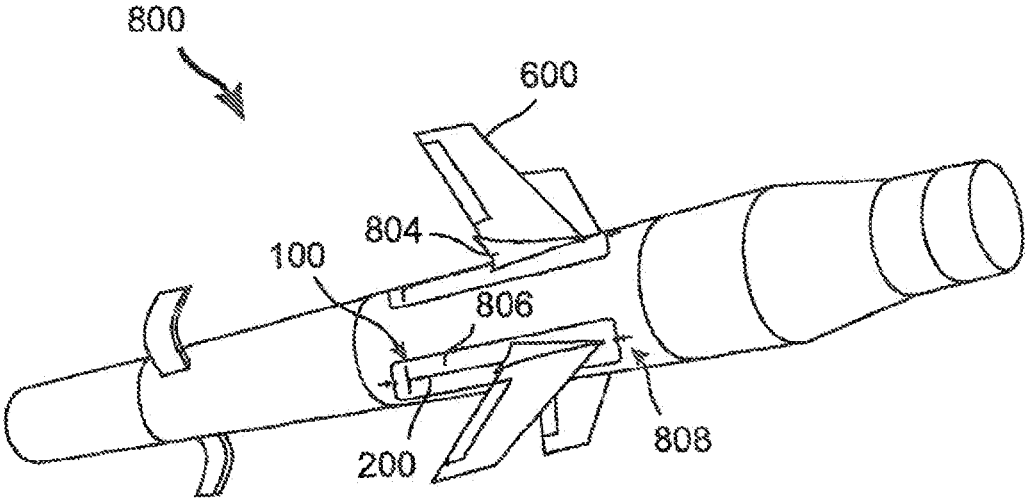
FIG. 8B is a perspective view of the aerial missile of FIG. 8A with an embodiment of the present invention installed, showing the conformance of portions of the wing slot seals against sides of the deployed wings, and showing closure of the wing slots by portions of the wing slot seals which are not adjacent to the wings.

FIG. 8A is a perspective view of a typical folded wing missile 800 shown without wing slot seals. The open wing slots 802 through which the folded wings 600 have been deployed are clearly visible. FIG. 8B is a perspective view of the missile 800 of FIG. 8A, shown with the wings 600 deployed through wing slot seals of an embodiment of the present invention 100. In the embodiment of FIG. 8B, at least one layer of the flexible sheet 102 is resilient or "springy," so that once the wing 600 has been deployed, the portions 804 of the flexible sheet 206 which lie against the deployed wing 600 remain substantially flush against the wing 600, while other portions 806 of the flexible sheet which are not adjacent to the deployed wing spring back into place and thereby close the remaining portion of the wing slot.

With reference to FIG. 3C, the two portions 804, 806 of the flexible sheet 102 are defined by additional cuts 300, 302 in the inner layer 204, which enable the formation of approximately triangular flaps 804 that press against the deployed wing 600, and approximately rectangular flaps 806 that do not adjoin the deployed wing 600, and that spring back into place so as to cover the remainder of the wing slot after the wing 600 has deployed. The effect of the frangible seal 100 on the aerodynamics of the rocket or missile 800 is thereby minimized.

In the embodiment of FIG. 8B, the wing slot seals 100 further include notches at each end 808 which are used to precisely align the seals with corresponding marking provided on the fuselage of the rocket or missile 800, thereby ensuring that the burst seam 200 and the additional cuts 300, 302 are properly aligned with the guidance wing 600.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A frangible wing slot seal suitable for preventing penetration of contaminants through a wing slot provided in the fuselage of a folding fin aerial rocket or missile, the wing slot seal being frangible so as to permit deployment of a guidance wing through the wing slot by breaking of the guidance wing through the wing slot seal, the wing slot seal comprising:

a barrier sheet having an inner layer and an outer layer, the barrier sheet having dimensions sufficient for covering the wing slot and for overlapping a region of fuselage surrounding the wing slot, the barrier sheet having a curvature corresponding substantially to a curvature of the fuselage, at least one of the inner and outer layers being a stiff layer which is resistant to deformation;

a burst seam formed in the stiff layer of the barrier sheet, the burst seam being configured so as to allow a guidance wing to separate and pass through the burst seam during deployment of the guidance wing, the burst seam being configured to close and resist penetration when a force is applied to the barrier sheet from outside of the rocket or missile; and an adhesive layer at least applicable to an inner surface of the barrier sheet, the adhesive layer being configured for adhering the barrier sheet to the region of fuselage surrounding the wing slot, the adhesive layer providing an adhesive strength which is sufficient to maintain the barrier sheet in position over the wing slot while the guidance wing breaks through the barrier sheet during deployment of the guidance wing.

2. The wing slot seal of claim 1, wherein the stiff layer is the inner layer of the barrier sheet.

3. The wing slot seal of claim 1, wherein at least one of the inner layer and the outer layer of the barrier sheet is a resilient layer which tends to restore the barrier sheet to its original configuration after the guidance wing has broken through the barrier sheet.

4. The wing slot seal of claim 3, further comprising at least one cross-seam formed in the stiff layer and configured so as to cause the formation of a first pair of flaps and a second pair of flaps in the barrier sheet when the guidance wing breaks thorough the barrier sheet, the first pair of flaps being configured to rest against the guidance wing after the guidance wing is deployed, and the second pair of flaps being configured to return approximately to its original configuration and to thereby at least partly cover the wing slot after the guidance wing has been deployed.

5. The wing slot seal of claim 4, wherein the first pair of flaps is approximately triangular in shape, and the second pair of flaps is approximately rectangular in shape.

6. The wing slot seal of claim 1, wherein one of the layers of the barrier sheet is a layer of half-hard nickel sulfamate, and the other layer of the barrier sheet is a layer of full-hard nickel sulfamate.

7. The wing slot seal of claim 1, further comprising a burst initiating region which is contiguous with the burst seam and formed at a location of initial contact between the deploying guidance wing and the barrier sheet, the inner layer being absent from the burst initiating region, the burst initiating region including at least one burst assisting feature attached to the outer layer in the burst initiating region, the burst assisting feature, upon contact with the deploying guidance wing, tending to press against and perforate the outer layer of the barrier sheet.

8. The wing slot seal of claim 7, wherein the at least one burst assisting feature is formed of the material of the inner layer, and is shaped by exclusion of the inner layer material from a region surrounding the burst assisting feature.

9. The wing slot seal of claim 7, wherein the burst assisting feature is substantially co-planar with the inner layer of the barrier sheet, the burst assisting feature tending to tip out of the plane of the inner layer upon contact with the deploying guidance wing so as to press an edge of the burst assisting feature against the outer layer of the barrier sheet.

10. The wing slot seal of claim 9, wherein the edge of the burst assisting feature is at least one of sharp and pointed.

11. The wing slot seal of claim 1, wherein the wing slot seal is able to inhibit penetration of moisture through the wing slot.

12. The wing slot seal of claim 1, further comprising an alignment feature suitable for alignment with a compatible alignment feature provided on the fuselage of the rocket or missile, the alignment feature thereby facilitating attachment of the wing slot seal to the fuselage at a desired location and with a desired alignment.

* * * * *